US008834304B1

(12) United States Patent
Toronto et al.

(10) Patent No.: US 8,834,304 B1
(45) Date of Patent: Sep. 16, 2014

(54) BAT SWING QUALITY INDICATOR

(76) Inventors: Brian R. Toronto, Arnold, MD (US); James H. Wells, Oolitic, IN (US)

( * ) Notice: Subject to any disclaimer, the term of this patent is extended or adjusted under 35 U.S.C. 154(b) by 214 days.

(21) Appl. No.: 13/455,100

(22) Filed: Apr. 24, 2012

(51) Int. Cl.
*A63B 69/00* (2006.01)
*A63B 69/36* (2006.01)
*A63B 69/38* (2006.01)

(52) U.S. Cl.
USPC ..... 473/457; 473/461; 473/224; 473/234

(58) Field of Classification Search
USPC ..... 473/457, 519, 520, 564–568, 224, 234, 473/461, 463, 553
See application file for complete search history.

(56) References Cited

U.S. PATENT DOCUMENTS 1,519,052 A * 12/1924 Reach ..... 473/234
1,549,350 A * 8/1925 Deike ..... 473/234
3,113,781 A * 12/1963 Guier ..... 473/234
3,137,504 A 6/1964 Zordan
3,215,437 A 11/1965 Webb
3,498,616 A 3/1970 Hurst
4,283,057 A * 8/1981 Ragan ..... 473/234
4,635,935 A * 1/1987 Kane ..... 473/463
4,907,800 A * 3/1990 Passamaneck et al. ..... 473/457
4,953,868 A * 9/1990 Thompson et al. ..... 473/234
5,273,278 A * 12/1993 Becker ..... 473/457
5,577,966 A * 11/1996 Duran ..... 473/234
5,803,840 A * 9/1998 Young ..... 473/457
6,503,149 B2 1/2003 Jelinek
6,733,399 B2 * 5/2004 Koncelik, Jr. ..... 473/219
6,923,737 B1 8/2005 Walker
6,991,552 B2 1/2006 Burke
7,758,436 B2 7/2010 Reynolds
7,771,263 B2 8/2010 Telford

* cited by examiner

*Primary Examiner* — Mark Graham
(74) *Attorney, Agent, or Firm* — Mark Clodfelter

(57) ABSTRACT

A training or safety aid for a baseball bat is disclosed. The device is configured to be placed on a bat, and indicators, which may be sound producing devices, produce a noise in accordance with selected qualities of the swing. In some embodiments, a flute-type opening is used, and may be configured with tubes to determine a pitch of a produced tone. An air scoop or funnel may be used with any of the devices that utilize airflow to produce a tone. Where more than one sound producing device is used, the devices are configured to only produce a sound within a narrow angular range of airflow, and are angularly spaced so as to produce sounds during different portions of a bat swing.

15 Claims, 5 Drawing Sheets

BAT SWING QUALITY INDICATOR

FIELD OF THE INVENTION

This invention relates to baseball bat accessories, and particularly to a baseball bat accessory that indicates swing quality or other aspects of a bat swung by a batter.

BACKGROUND OF THE INVENTION

On its face, swinging a baseball bat properly may seem to be an easy endeavor. Where a bat is swung correctly, the top hand, with respect to the bat held vertically with one hand above the other, is rolled or rotated over the bottom hand. This motion is commonly referred to as "breaking the wrists", and begins just prior to contact with a ball. The result is a snapping or whipping motion of the bat, and provides additional power and leverage as the ball is struck. However, without practice concentrating on a proper way to swing a baseball bat, bad habits can be developed. For instance, the batter may prematurely release the top hand from the bat, which generally causes the batter to lose control over where the ball is hit into the field. Another bad habit that may be developed may be to prematurely rotate the top hand over the bottom hand, which generally causes the ball to be hit in a downward direction. In both of these improper techniques, power of the bat impinging on the ball is sacrificed, and directional control is lost.

DETAILED DESCRIPTION OF THE DRAWINGS

Figure 1:
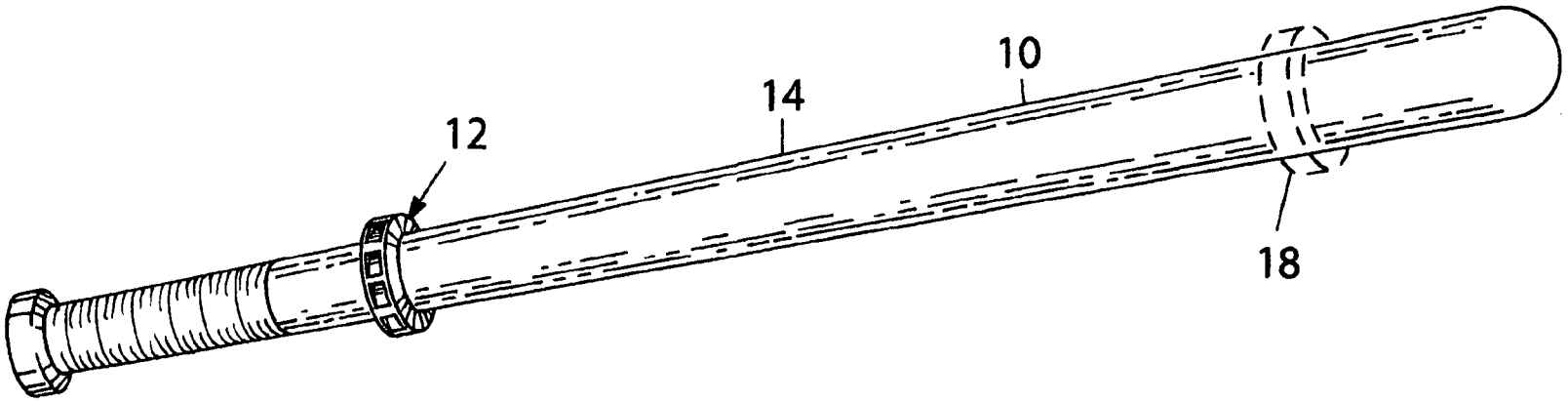
FIG. 1 is a view of a bat showing possible positions of my new bat swing quality indicator.

FIG. 1 is an illustration of a baseball bat 10, and an accessory 12 that may be in the form of a bat ring that slides over an exterior barrel portion 14 of a bat, or is otherwise attached to a bat. Significantly, this allows any bat to be used as a training aid or safety device rather than having a special bat to serve as a training aid. The ring may be fabricated of plastic, rubber, graphite, cloth, metal or any material or composite material suitable for bat ring construction. While an accessory in the form of a ring is disclosed, accessory 12 may be in the form of a clamp where the ring, or structure as disclosed in the form of a clamp, is constructed in two segments or halves that are hinged at one end, and provided with fasteners or an adjustable latch, such as a ratcheting latch, at the other end so that the ring or clamp can be clamped anywhere along the length of a baseball bat. In some instances, the ring may be placed near the distal end of the bat, as shown in dashed line showing 18 of a ring in FIG. 1, or near the batter's hands as shown by ring 12, or at any intermediate position on the bat. In another embodiment, in lieu of a latch to hold a ring or the like in place on the bat, a tension spring may hold or clamp portions of the instant invention together, and in a secure relationship to the bat.

Figure 2:
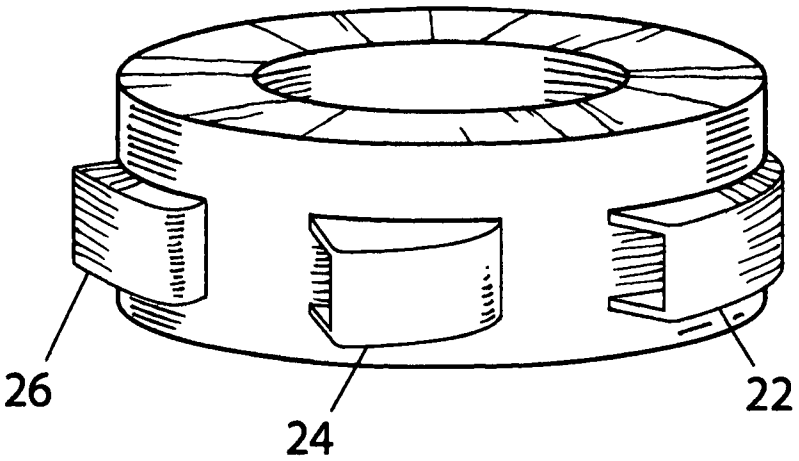
FIG. 2 is a perspective view of my new bat swing quality indicator.

In order to facilitate the ring gripping the bat and maintaining a position thereon, an interior surface 20 (FIG. 2) of the ring may be coated with or have attached thereto a frictional material, such as a frictional coating, a frictional sheet material such as sheet rubber, nitrile, plastic or the like. Similarly, frictional shims may be provided between the bat and interior surface 20 of the ring. In other embodiments, rather than a ring, the accessory may be a patch that is adhesively fixed anywhere along the length of the bat. In any instance, the ring, clamp or the like is attached at a selected location on the bat.

The accessory device attached to the bat is provided with one or more indicators, which may be sound producing devices 22, 24, 26 (FIG. 2) that make a sound when the bat is swung by a batter. Such indicators utilize airflow as the bat is swung to make sounds in the same manner as a wind whistle, a flute mouthpiece, vibrating elements similar to those found in a harmonica, or the like. The sound or other indication may be a whistle, a buzz or vibration, or a humming sound, such as from a small sound-producing propeller mounted to the bat and receiving airflow as the bat is swung. In one embodiment, a flexible harmonica-like accessory using reeds or other vibrating elements may be constructed so that the accessory may be wrapped around a baseball bat and affixed thereto. When the bat is swung, airflow through the harmonica-like reeds produce a sound.

Figure 3:
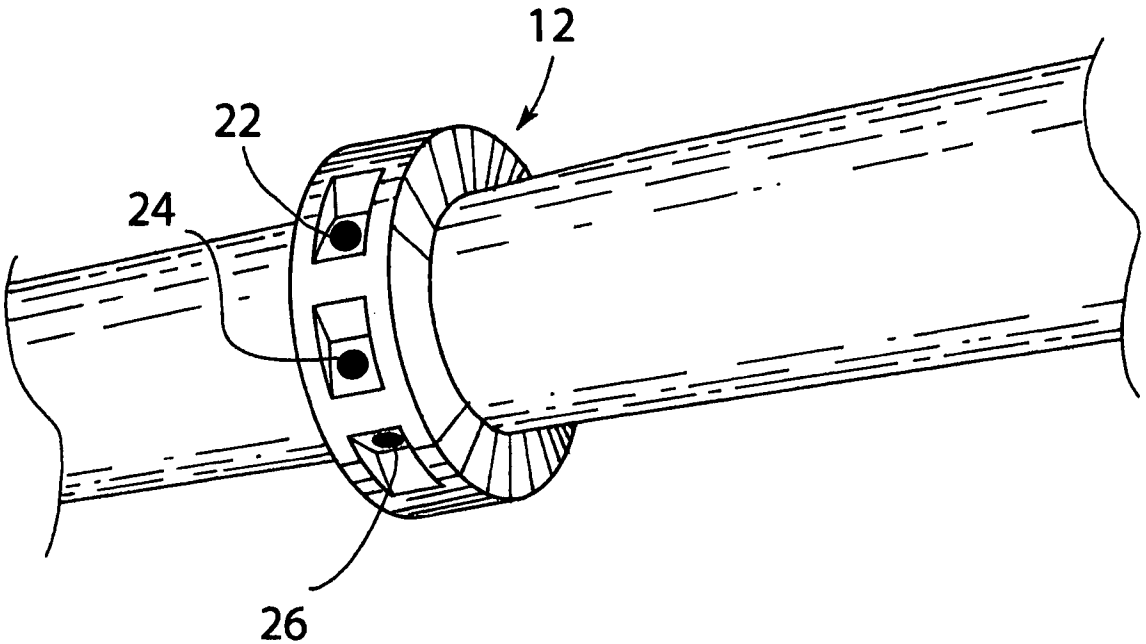
FIG. 3 is an enlarged view of my new bat swing quality indicator.

In some applications, the indicator may be placed on a bat at a location so that a sound is produced when the bat reaches its highest velocity, typically at a point where the ball is struck. Here, it has been found that a device known in the art as a "mosquito whistle" will make a chirp-like sound when the bat reaches maximum velocity, with the mosquito whistle placed at any position at the distal end of the bat.

Where more than one sound-producing device is disposed on the accessory, such as shown in FIG. 3, each sound-producing device may produce a different tone or note. As the bat is swung, the tones may combine to form a chord, or the tones may sound sequentially as the bat is swung so as to form an ascending or descending scale, or a scale that has a higher or lower pitch in the middle of the swing. Importantly, one or more distinct tones are produced when the bat is properly rolled with the hands as it is swung.

As part of the mechanics of a bat swing from a cocked position over a shoulder to completion of the swing where the bat is somewhere on the other side of the body, and as earlier stated, the natural motion of the wrists roll the bat approximately 180 degrees about its axis. The rotation is not linear; rather, the bat rotates more during the end of the swing than in the beginning, and not so much during the middle portion of the swing. Thus, with an accessory such as the aforementioned bat ring, the accessory may be selectively positioned on the bat so that, where a single indicator or other sound-producing device is used, a single tone or other indication is produced when the bat is rotated to a point just before about the middle of the swing where the bat would be over home plate, and to a position where the sound producing device is receiving sufficient airflow to produce the indication. Where there are a plurality of sound producing devices on the ring, the ring is positioned on the bat so that each device receives airflow in turn as the bat is rotated about its axis during the swing. In this instance, each sound-producing device or devices produces sound at different, selected positions of rotation about the axis of the bat. As such, the ring or accessory may be positioned about an axis of a bat so that indicator device 22 (FIG. 3) receives activating airflow and produces a sound at the beginning of a swing, indicator device 24 receives activating airflow at about the middle or halfway through the swing, and indicator device 26 receives activating airflow at the end of a swing.

Figure 4:
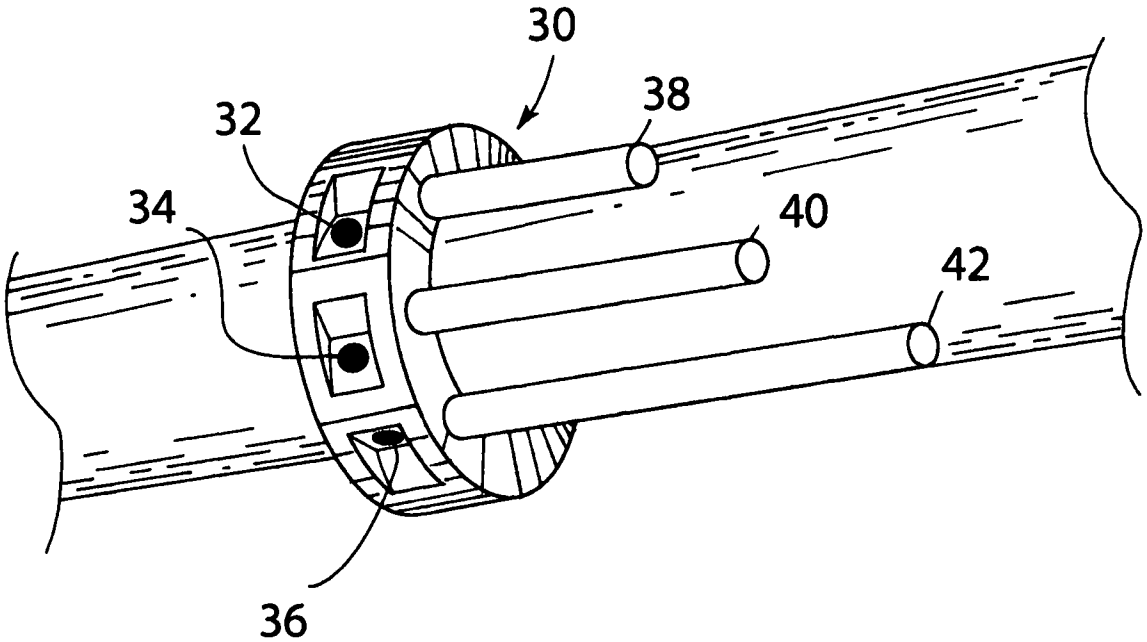
FIG. 4 is a view of an embodiment using tone pipes.

In order for sounds to be produced in the described order, each indicator device must be configured to produce a sound within a relatively narrow angular range of airflow over or across the sound-producing device. As noted above, a flute-type sound producing device may be used, and which uses an opening wherein air is blown across or slightly down into the opening in order to produce a sound. The angle at which air is blown across the opening in order to produce a tone is relatively critical, being within a range of about 5 degrees to perhaps 15 or 20 degrees or so. When placed on a ring 30 as shown in FIG. 4, the flute-type openings may be spaced apart at angles depending on the desired result. As such, where three distinct tones are to be produced during a bat swing, and where each opening produces a tone within approximately a 15 degree range of airflow across the opening, the openings 32, 34 and 36 would be located at angular spacings of between about 30 degrees to about 60 degrees, assuming a baseball bat is rotated about 180 degrees during a swing. Such spacing should produce three distinct chirps or tones during a swing. The tones may be made to occur closer together by reducing the angular spacing between the flute-type openings.

The tones may be varied by associating a differently sized air column with each opening. Here, similar to a flute, a shorter air column produces a higher pitch, and a longer air column produces a lower pitch. As such, a ring 12 (FIG. 2) may have a respective tube 38, 40, 42 for each opening 32, 34 and 36, these tubes being different lengths (or the same lengths) and extending as shown along the exterior of the bat and parallel to the bat, although other orientations are possible.

Figure 5:
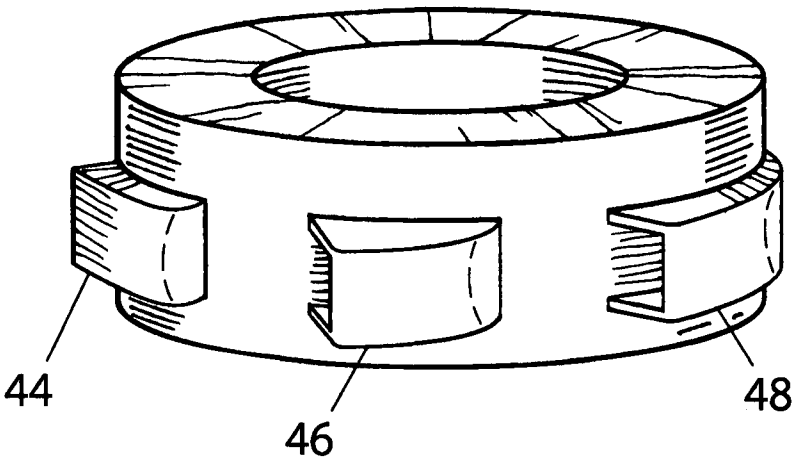
FIG. 5 is is a view of another embodiment of the invention.

In addition to varying the tones, air scoops 44, 46 and 48 (FIG. 5) may be provided over devices 22, 24 and 26 (FIG. 3) in order to accelerate airflow over a respective device, making the sound louder or more pronounced. In addition, such air scoops may shield the respective device from any laminar airflow around the bat that otherwise may cause a device to produce a sound at an unintended time. Where flute-like openings 32, 34 and 36 are used, the scoops 44, 46 and 48 may have the rear or smaller regions thereof cut away (dashed lines) so that the scoop serves as an accelerator to funnel airflow over a respective opening at a faster rate than otherwise would occur. Here, the openings 32, 34 and 36 would be placed at a point of highest flow rate across the opening. The scoops may be made as large or as small as needed to sufficiently accelerate air across a sound producing device or opening. Likewise, the tone tubes 38, 40 and 42 may be made as long or as short as needed to produce the desired tones. Additionally, the tubes may be made adjustable so as to adjust the tones by constructing them from lockable sections of telescoping tubing.

As noted, as the bat rotates approximately 180 degrees as it is swung, an indicator device that makes a sound at the beginning of the swing should be configured to begin to make a sound as the bat picks up speed to develop sufficient airflow across or through the indicator device, which may be anywhere from a few inches of travel to about a foot or so. In any case, during a mechanically correct swing of a baseball bat, and as noted, the first device 22 (or opening 32) will produce a sound during about the first quarter to one third of the bat swing, during which the bat rotates about its axis about 45 degrees or so. Thus, a first indicator device should produce a sound with airflow flowing across or through it within a range of angles of about 30 degrees or so, or 5-20 degrees or so for a flute-type opening. With this construction, by the time the first indicator device is about ⅓ through the swing, sound from it should stop or diminish, and the second device 24 (or opening 34) should begin to be producing sound.

During the middle of the swing, the bat is rotated minimally, perhaps only about 20 degrees to about 30 degrees or so about its axis. This is because it is desirable for the bat to be rotating as little as possible as it contacts the ball as rotation of the bat could cause the ball to be directed toward the ground. As such, a second device 24 produces a longer duration sound during the middle portion of the swing, and should be oriented to receive airflow after the bat has rotated the initial 45 degrees or so. This device or opening would be configured to produce sound with an angular airflow range of up to about 20 degrees to 30 degrees or so.

The most rotation of the bat about its axis during a swing occurs in the last third of the swing in which the bat rotates about its axis about 100 degrees or more. Thus, the third indicator device should begin to produce a sound after the bat has rotated about 70 degrees or so, and should be configured to produce sound with an angular airflow range of perhaps 50 degrees or more. As the last part of the third portion of the swing is basically a follow-through after the ball has been hit, this portion of the swing is perhaps not quite as important as the initial and middle portions of the swing.

While an accessory having three sound producing devices is disclosed in detail, it should be apparent that more or fewer sound (or other indication) producing devices could be used. Here, a rattle could be produced within a ring-type accessory. Also, as noted, 2 or more sound producing devices could produce sound simultaneously, perhaps to form a chord or discordant sound. Here, a chord sound may be produced if the bat were swung correctly, and a discordant sound may be produced if the bat were swung incorrectly. This may be accomplished by using two or more accessory devices in conjunction with each other, such as placing two of the rings 12 together on a bat, each ring having sound producing devices that produce different tones on the same bat, with the sound producing devices arranged to produce the aforementioned chord or discordant sounds according to the quality of the swing, i.e. a longer duration harmonic chord in the middle of the swing. In another embodiment, sound producing devices may be arranged on a single accessory to produce the harmonic or discordant sounds.

It should also be apparent that, in order to take best advantage of rotation of a bat during a swing, the sound producing devices may be mounted at selected spacings so as to each produce a sound in turn as the bat is rotated. It should also be apparent that the accessory and sound producing devices can be adapted to other sport implements, such as golf clubs, cricket bats, or any other implement that is swung through the air.

With respect to other indicators of the quality of a bat swing, such as 2 or more different colors of tape that extends perhaps a foot or 2 along the length of the bat, and perhaps ½ to 1 inch each, may be used. Here, where red and green strips of tape are used, when the bat is swung fast enough, the colors would blend to form yellow. Spacing of the strips of tape would determine how fast the bat must be swung in order to blend the colors. For children or adolescents, the strips of tape may be placed almost next to each other, while for adults, the spacing would be greater, perhaps an inch or so apart, depending on the strength of the batter. Similarly, some form of an optical illusion may be printed or attached to the bat, in order to determine some aspect of the swing quality. In one embodiment, an optical illusion may be a linear strip of lights, such as LED lights, that are illuminated during a swing to spell a word or create some visible symbol. This may be implemented by a weight sliding through a cylinder within the bat, and triggering the lights at selected positions along the cylinder. The weight would resist centrifugal force as the bat is swung, as by the weight closely fitting in the cylinder and having a restrictive valve that would cause the weight to move at a selected speed depending on the speed of the swing. In a similar embodiment, the lights may point toward or indicate a sweet spot on the bat as the bat is swung. In yet another embodiment related to how fast a bat is swung, a small propeller-driven device may be temporarily or permanently mounted to the bat, with the wind speed or rate of rotation of the propeller calibrated to indicate bat speed. In other embodiments, a tubular, spring loaded sound producing device may be provided in the distal end of a bat so that when swung, centrifugal force would cause the sound producing device to slide out of a housing and into an airstream and produce a sound from the end of the bat. This embodiment would make a sound according to velocity of the bat swing. When not used, a cap may be placed over the end of the bat, or the spring loaded device may be configured to be locked in place, as by rotating it in its socket to a locking position.

Other sounds an accessory may be configured to make could be a popping noise when the bat exceeds a selected velocity. This may be accomplished by a device triggered by centrifugal force. In other embodiments, the sound-producing devices may be integrated into ring or other exercise weights used on a bat. Further, the bat accessory of the instant invention may be used as a safety device to alert others in the area that a bat is being swung.

In use, a batter would take his stance, and hold a bat with the disclosed accessory thereon in the same manner as though he was going to swing the bat. The bat swinger would then hold the bat straight out in front, parallel to the ground, i.e. a point of fastest velocity of a swung bat, and rotate the bat so that the indicator or sound producing device (or flute-type opening) is in a position to receive air flow and produce a sound when the bat is at this position, typically over home plate. Where there are more than one indicators or openings, the sound producing indicator that produces a sound in the middle of the swing, i.e. over home plate, is oriented to receive the airflow and produce a sound. Holding the bat with the sound producing devices so oriented, the bat swinger may then practice swinging the bat.

Having thus described my invention and the manner of its use, it should be apparent to those skilled in the relevant arts that incidental changes may be made thereto that fairly fall within the scope of the following appended claims, wherein

We claim:

1. A device for evaluating swing quality comprising:

an implement that is swung to hit a ball or the like, a plurality of swing quality detectors mounted at selected radial spacings about a shaft of said implement and on an exterior of said implement that indicate quality of a swing of said implement, wherein each swing quality detector of said plurality of swing quality detectors produces a sound during a respective different portion of a swing of said implement, with substantially only one of said swing quality detectors producing a sound at a time, said one or more swing quality detectors configured to produce sound indicative of said swing quality by interacting with air as said implement is swung.

2. A device for evaluating swing quality as set forth in claim 1 further comprising constructing said one or more swing quality detectors on a mount easily attachable to and easily detachable from said implement.

3. A device for evaluating swing quality as set forth in claim 1 wherein each of said said plurality of swing quality detectors is mounted to said implement at a respective location to interact with said air over a respective predetermined angular range of rotation about a long axis of said implement to indicate said swing quality of a portion of said swing.

4. A device for evaluating swing quality as set forth in claim 3 wherein said location of one of said plurality of swing quality detectors is a location to indicate swing quality during a portion of said swing within which said ball or the like is intended to be struck.

5. A device for evaluating swing quality as set forth in claim 4 wherein said predetermined angular range is between about 5 degrees to about 20 degrees of rotation about a long axis of said implement as said implement is swung.

6. A device for evaluating swing quality as set forth in claim 1 wherein said plurality of swing quality indicators are each configured to produce a said sound over a predetermined angular range of between about 5 degrees to about 20 degrees of rotation about a long axis of said implement as said implement is swung.

7. A device for evaluating swing quality as set forth in claim 1 wherein said selected radial spacings are between about 30 degrees to about 60 degrees of rotation about a long axis of said implement.

8. A device for evaluating swing quality as set forth in claim 1 wherein said implement is a baseball bat that is rotated approximately 180 degrees about its long axis during a full swing thereof.

9. A device for evaluating swing quality as set forth in claim 1 wherein said implement is a baseball bat, said baseball bat rotated about 180 degrees about its long axis during a full swing thereof, said plurality of swing quality detectors mounted at said selected radial spacings to indicate said swing quality of a beginning said portion of said swing, a middle said portion of said swing and an end said portion of said swing.

10. A device for evaluating swing quality as set forth in claim 9 further comprising configuring a swing quality detector indicating said middle portion of said swing to produce said sound within a range of up to about 20 degrees rotation of said baseball bat about a long axis thereof.

11. A device for evaluating swing quality as set forth in claim 2 further comprising constructing said swing quality detectors on a ring configured to be fitted to an exterior of a baseball bat.

12. A device for evaluating swing quality of a baseball bat as it is swung, said device comprising:

a baseball bat ring easily affixed to and easily removable from said baseball bat at least one swing quality detector mounted to said baseball bat ring, said at least one swing quality detector configured to interact with air and produce sound indicative of swing quality as said baseball bat is swung, at least one air scoop associated with said at least one swing quality detector, for accelerating or otherwise enhancing flow of said air to or through said at least one swing quality detector as said baseball bat is swung, said sound indicative of swing quality indicating proper rotation of said baseball bat about its long axis as the baseball bat is swung through an arc of at least 180 degrees.

13. A method for indicating swing quality of an implement used for hitting a ball or the like comprising:

configuring a plurality of swing quality detectors to interact with a flow of air as said implement is swung, mounting said plurality of swing quality detectors to said implement at selected radial spacings around an exterior thereof, orienting said implement so that swinging said implement results in airflow to substantially one swing quality detector of said plurality of swing quality detectors at a time, producing a sound from a respective said swing quality detector during a respective predetermined portion of said swing, each said predetermined portion of said swing being less than a full swing of said implement, thereby indicating said swing quality of said implement.

14. The method as set forth in claim 13 further comprising prior to swinging said implement, orienting said implement so that a one of said swing quality detectors that produces sound during a middle portion of said swing is positioned to receive maximum said airflow during said middle portion of said swing, and at a location of said middle portion of said swing where it is expected that said ball or the like is to be struck.

15. A device for indicating swing quality as set forth in claim 12 further comprising said at least one swing quality detector mounted to said baseball bat in a location to indicate said swing quality during a portion of said swing within which a ball is intended to be struck.

* * * * *